US007823514B2

(12) United States Patent
Forbes et al.

(10) Patent No.: US 7,823,514 B2
(45) Date of Patent: Nov. 2, 2010

(54) HOPPER CAR SIDE CONSTRUCTION AND METHOD

(75) Inventors: James W. Forbes, Campbellville (CA); Jeffrey D. Reid, Dunnville (CA)

(73) Assignee: National Steel Car Limited (CA)

( * ) Notice: Subject to any disclaimer, the term of this patent is extended or adjusted under 35 U.S.C. 154(b) by 471 days.

(21) Appl. No.: 11/566,000

(22) Filed: Dec. 1, 2006

(65) Prior Publication Data

US 2008/0127854 A1 Jun. 5, 2008

(51) Int. Cl.
*B61D 3/00* (2006.01)

(52) U.S. Cl. ..... 105/247; 105/248; 105/249; 105/404; 105/409; 105/410

(58) Field of Classification Search ..... 105/247, 105/248, 249, 404, 409, 410; 298/24, 25, 298/26

See application file for complete search history.

(56) References Cited

U.S. PATENT DOCUMENTS

| | | | | |
|---|---|---|---|---|
| 3,490,387 | A | 1/1970 | Halcomb | |
| 4,262,602 | A | 4/1981 | Patil et al. | |
| 4,275,662 | A * | 6/1981 | Adler et al. | 105/377.01 |
| 4,377,058 | A | 3/1983 | Hallam et al. | |
| 4,385,563 | A | 5/1983 | Bell et al. | |
| 4,444,123 | A * | 4/1984 | Smith et al. | 105/377.01 |
| 4,455,947 | A | 6/1984 | Reeve et al. | |
| RE32,189 | E * | 6/1986 | Adler et al. | 105/377.07 |
| 4,875,417 | A | 10/1989 | Coulborn et al. | |
| 6,044,771 | A * | 4/2000 | Nguyen | 105/247 |
| 6,164,210 | A * | 12/2000 | Coslovi et al. | 105/396 |
| 6,865,992 | B1 * | 3/2005 | Fetterman et al. | 105/247 |
| 2007/0101895 | A1 * | 5/2007 | Forbes et al. | 105/406.1 |
| 2007/0101896 | A1 * | 5/2007 | Forbes et al. | 105/406.1 |
| 2007/0277696 | A1 * | 12/2007 | Forbes | 105/406.1 |
| 2008/0066642 | A1 * | 3/2008 | Forbes et al. | 105/247 |
| 2008/0127854 | A1 * | 6/2008 | Forbes et al. | 105/247 |

OTHER PUBLICATIONS

1997 Car and Locomotive Cyclopedia of American Practices, 6th ed., Simmons-Boardman, Omaha, Section 1, "Covered Hoppers", pp. 95-114.*

* cited by examiner

*Primary Examiner*—S. Joseph Morano
*Assistant Examiner*—Jason C Smith
(74) *Attorney, Agent, or Firm*—Hahn Loeser & Parks LLP; Michael H. Minns

(57) ABSTRACT

A hopper car has arcuate side sheets that are bent over the forming members of the structure to give a generally outwardly bulging shape. The upper margin of the side sheet is kinked inwardly of the radius of curvature of the larger portion of the side sheet more generally, such as may tend to impose a bending moment on the large, relatively thin side sheet panels. This may in turn tend to urge or bias those panels to a bulging position or shape, rather than a sagging, deflected, or inwardly dented position.

22 Claims, 7 Drawing Sheets

HOPPER CAR SIDE CONSTRUCTION AND METHOD

FIELD OF THE INVENTION

This invention relates to the field of rail road freight cars, and, in particular to rail road hopper cars.

BACKGROUND

There are many kinds of rail road cars for carrying particulate material, be it sand or gravel aggregate, plastic pellets, grains, ores, potash, coal or other granular materials. These materials are not liquid, yet may in some ways tend to flow in a quasi liquid-like manner under the influence of gravity. Many of those cars have an upper opening, or accessway of some kind, by which the particulate is loaded, and a lower opening, or accessway, or gate, by which the particulate material exits the car under the influence of gravity. The terminology "flow through" or "flow through rail road car" or "center flow" car, or the like, may sometimes be used for cars of this nature where lading is introduced at the top, and flows out at the bottom.

Some hopper cars have a primary construction that includes a pair of arcuate side walls and, typically, an arcuate roof, joined together in shell that has the general shape of a bulging inverted U. The sidewalls may be formed on a first radius or curvature about a first axis, and the roof sheet may be formed about a second radius of curvature about another axis. The roof and side wall sheets meet at the intersection of the two curves. There is, typically, a top chord structure located at or near this junction. Grain and plastic pellet cars often have this bulging arcuate shape.

SUMMARY OF THE INVENTION

In an aspect of the invention, there is a railroad hopper car, the hopper car having a body for carrying lading. The body includes side sheets. One of the side sheets has a lower portion and an upper portion extending therefrom. At least part of the lower portion is formed on an arc. The upper portion of the side sheet deviates to the concave side of the arc. The side sheet has a spring pre-load tending to urge the side sheet to an outwardly bulging condition.

In a feature of that aspect of the invention, the lower portion is a main portion of the side sheet, and the upper portion is a marginal portion of the side sheet. In another feature the first portion has a first arc length, the second portion has a second arc length, and the second arc length is in the range of 5% to 15% of the first arc length. In a further feature the side sheet is installed in a spring loaded condition tending to urge the first portion to an outwardly bulging condition. In still another feature, a top chord member is mounted to the second portion. In a further feature of that further feature, the hopper car has a roof sheet, and at least one of (a) the top chord member; and (b) the second portion is rigidly connected to the roof sheet. In a yet further feature the connection to the roof sheet maintains the side sheet in a spring loaded condition. In still another feature, the curve is a circular arc having a center of curvature and at least a portion of the upper, marginal portion of the side sheet is located closer to the center of curvature than the lower portion of the side sheet. In still yet a further feature the side sheet meets at least one of the following conditions: (a) the curve has a radius of curvature of at least 170 inches; and (b) the side sheet has a thickness and the curve is formed on a circular arc having a radius of curvature, there being an aspect ratio of the radius of curvature to the thickness that is at least as great as 900.

In another aspect of the invention, there is an internal forming member for a railroad hopper car. The forming member has a first profile portion to which a side sheet of the hopper car is to conform. The profile portion includes a lower portion and an upper portion. The lower portion is formed on an arc having a radius of curvature having a magnitude R about a center of curvature, R being larger than 170 inches. The upper portion deviates from the arc, and at least part of the upper portion lies closer than R to the center of curvature.

In another aspect of the invention, there is a railroad hopper car having a body for carrying lading. The body includes longitudinally extending, predominantly upwardly standing side sheets formed on an arcuate profile. The side sheets having a first portion and a second portion adjoining the first portion, the second portion and the first portion meeting at a transition, the main portion being formed on a curve, the marginal portion deviating from the curve at the transition; and, at least a portion of the second portion lying transversely inboard of an extension of the curve.

In another feature of that aspect of the invention, the first portion is a main portion of the side sheet, and the second portion is a marginal portion of the side sheet. In a further feature, the first portion is a lower portion of the side sheet, and the second portion is an upper portion of the side sheet. In still another feature the side sheet is installed in a spring loaded condition tending to urge the first portion to an outwardly bulging condition. in still another feature a top chord member is mounted to the second portion. In yet another feature, the hopper car has a roof sheet, and at least one of (a) the top chord member; and (b) the second portion is rigidly connected to the roof sheet. In another feature the connection to the roof sheet maintains the side sheet in a spring loaded condition. In still another feature, the curve is a circular arc having a center of curvature. At least a portion of the upper, marginal portion of the side sheet is located closer to the center of curvature than the lower portion of the side sheet. In still yet another further feature, the side sheet meets at least one of the following conditions: (a) the curve has a radius of curvature of at least 170 inches; and (b) the side sheet has a thickness and the curve is formed on a circular arc having a radius of curvature, there being an aspect ratio of the radius of curvature to the thickness that is at least as great as 900.

These and other aspects and features of the invention may be understood with reference to the description which follows, and with the aid of the illustrations of a number of examples.

BRIEF DESCRIPTION OF THE FIGURES

The description is accompanied by a set of illustrative Figures in which.

DETAILED DESCRIPTION

Figure 1A:
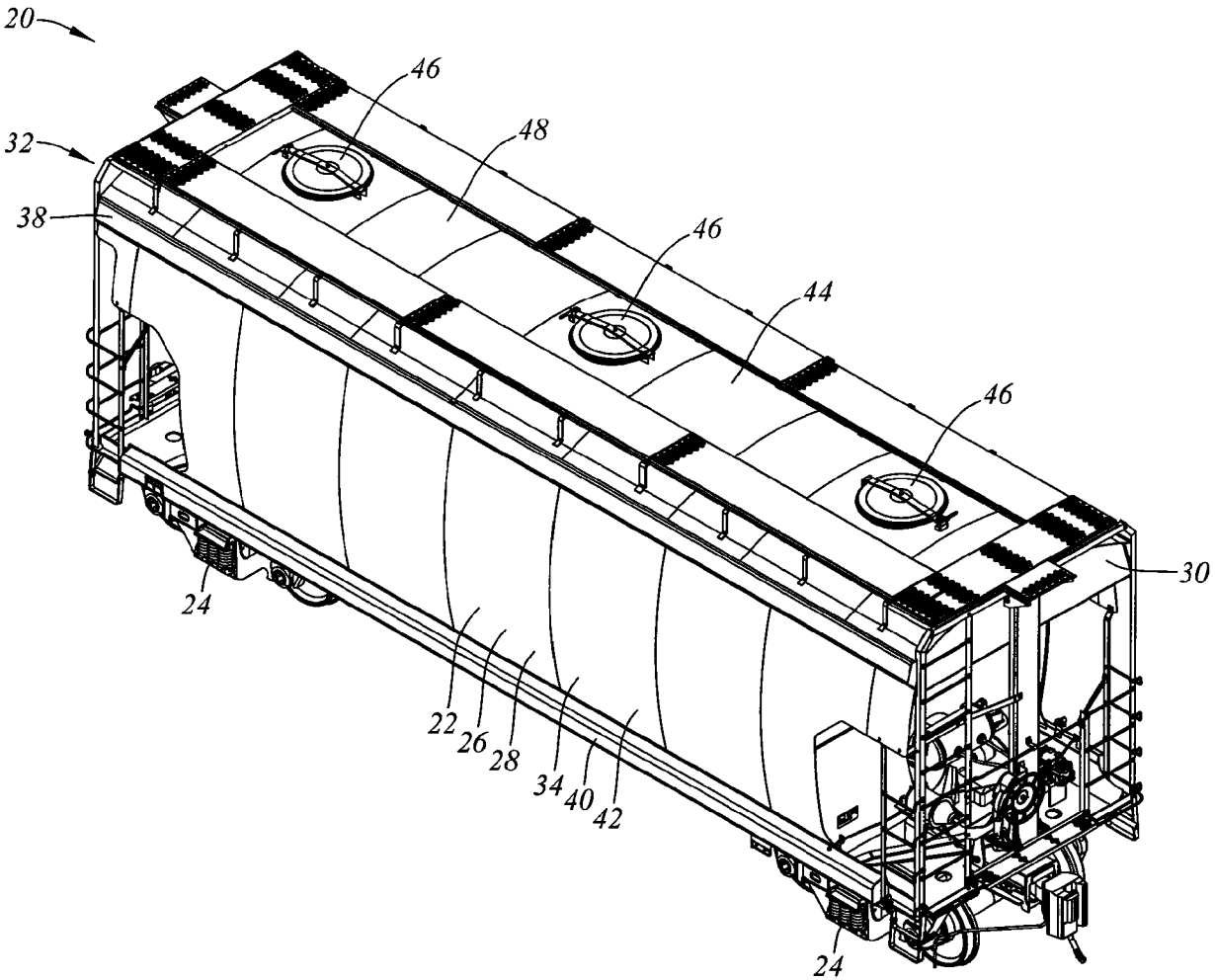
FIG. 1*a* is a general arrangement, isometric view of a rail road hopper car.
Figure 1B:
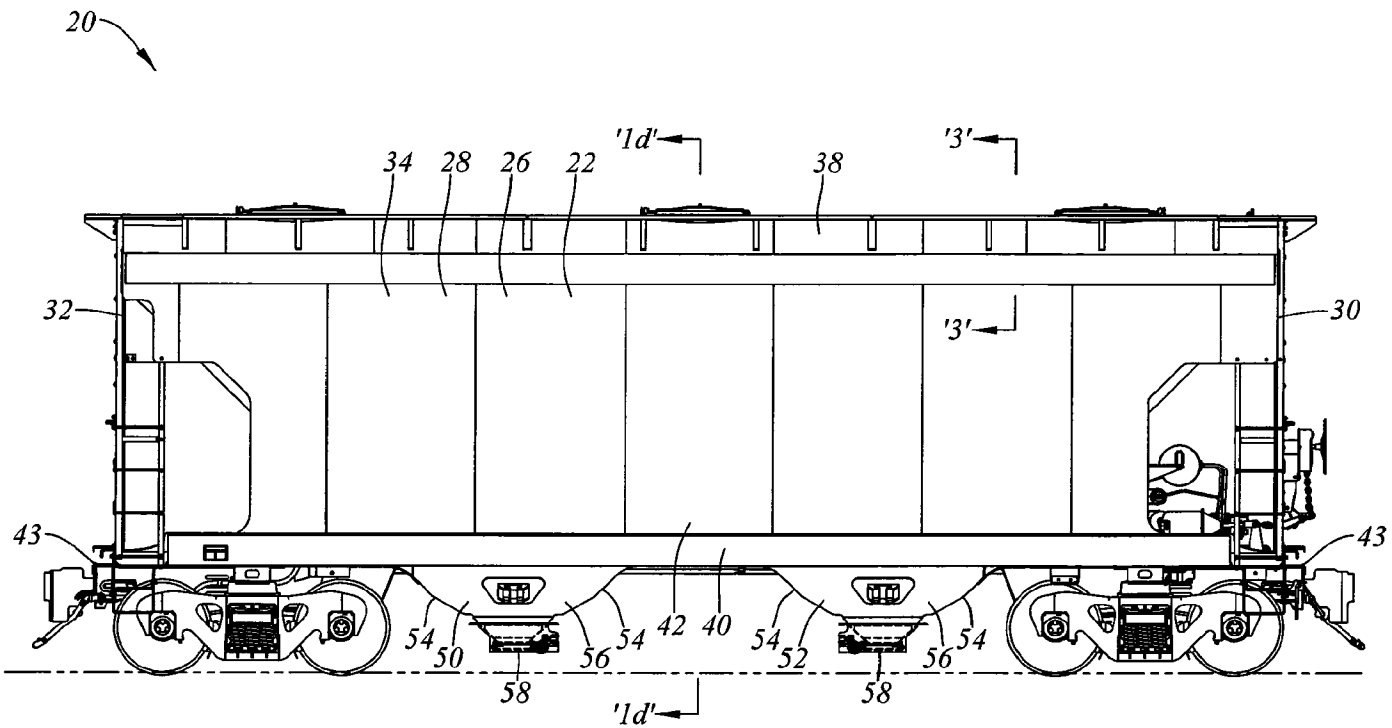
FIG. 1*b* is a side view of the hopper car of FIG. 1*a;*
Figure 1C:
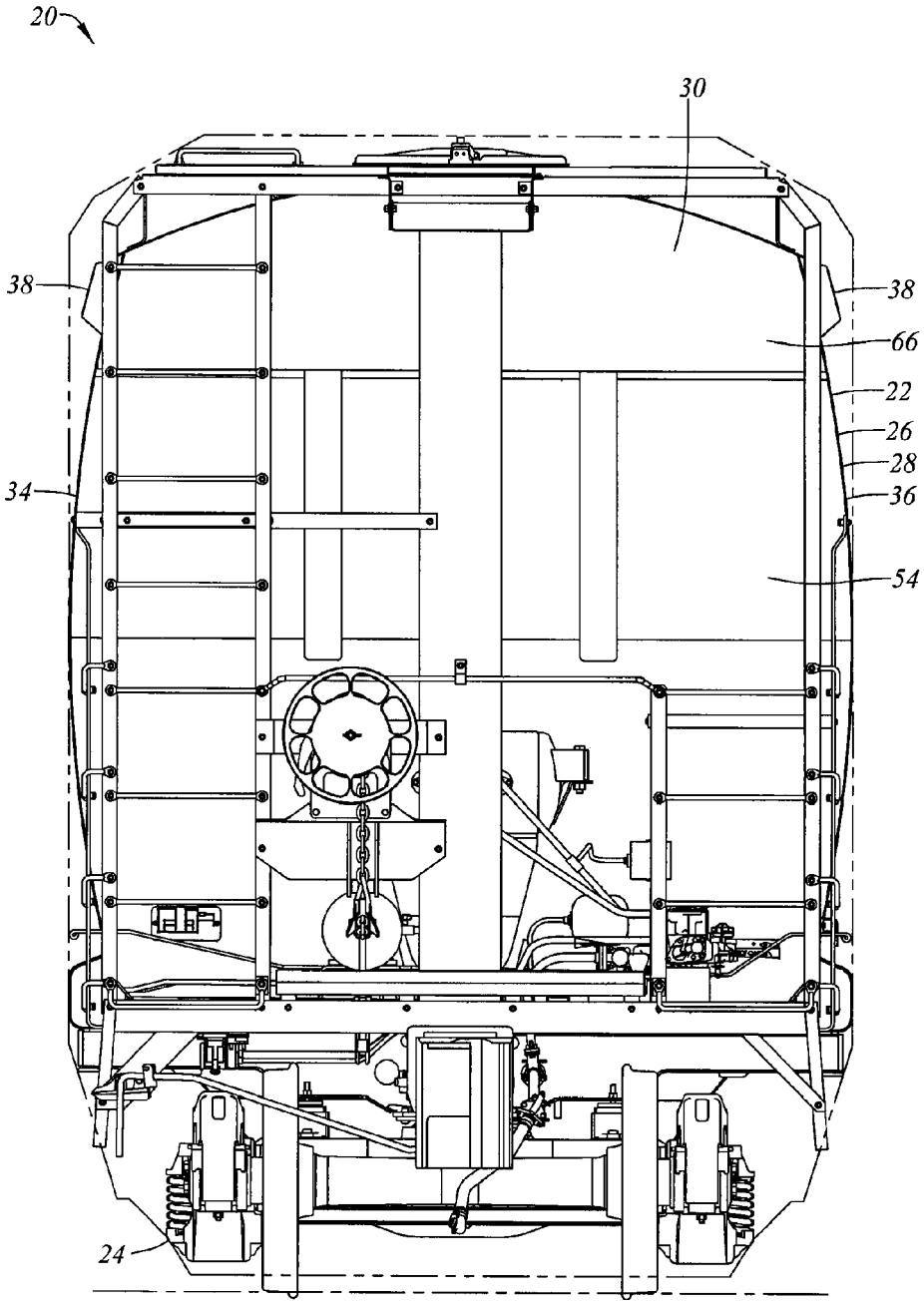
FIG. 1*c* is an end view of the hopper car of FIG. 1*a;*
Figure 1D:
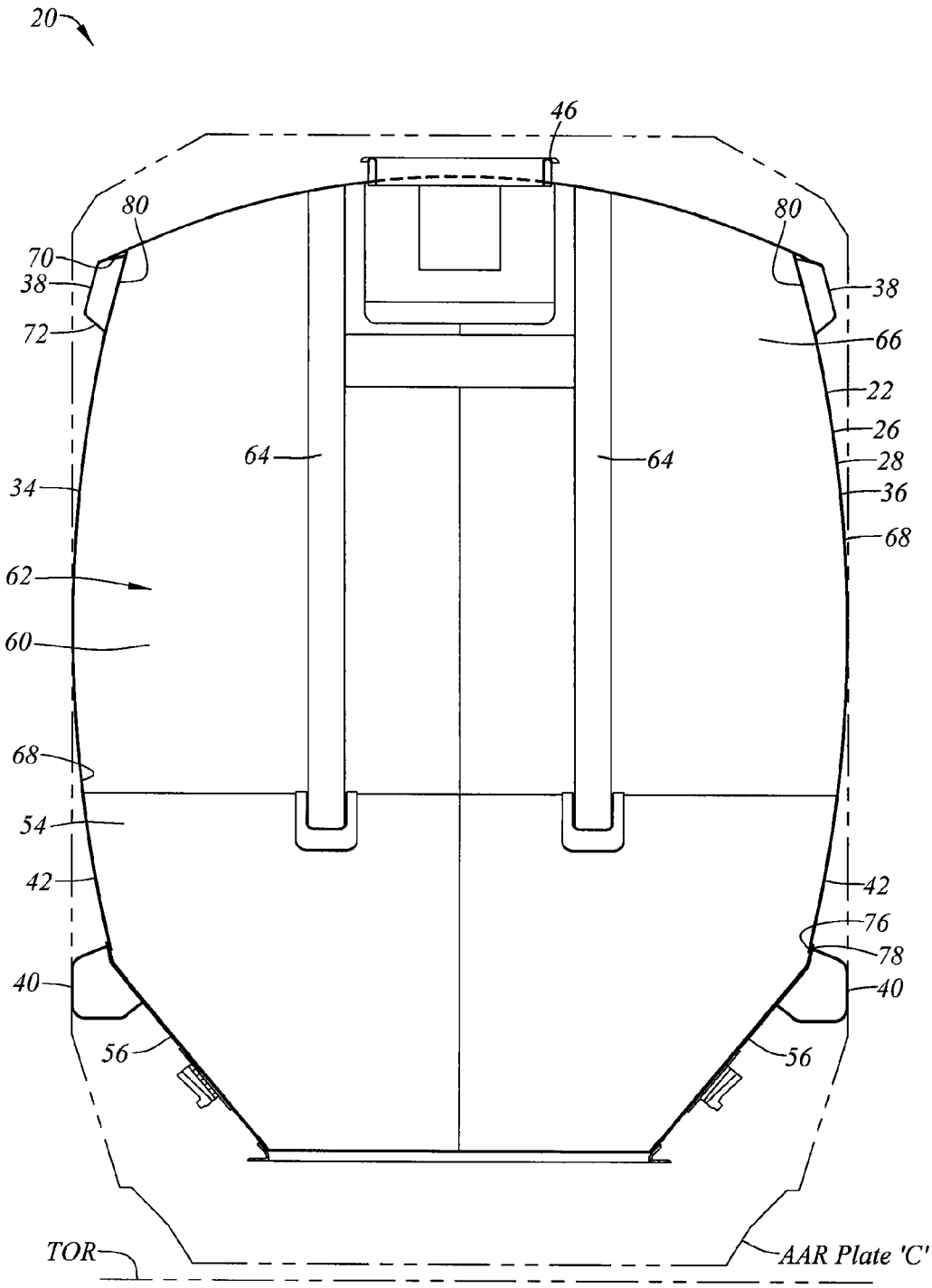
FIG. 1*d* is lateral cross-section of the rail road freight car of FIG. 1*a*, taken on section '1*d*-1*d*' of FIG. 1*b;*
Figure 2A:
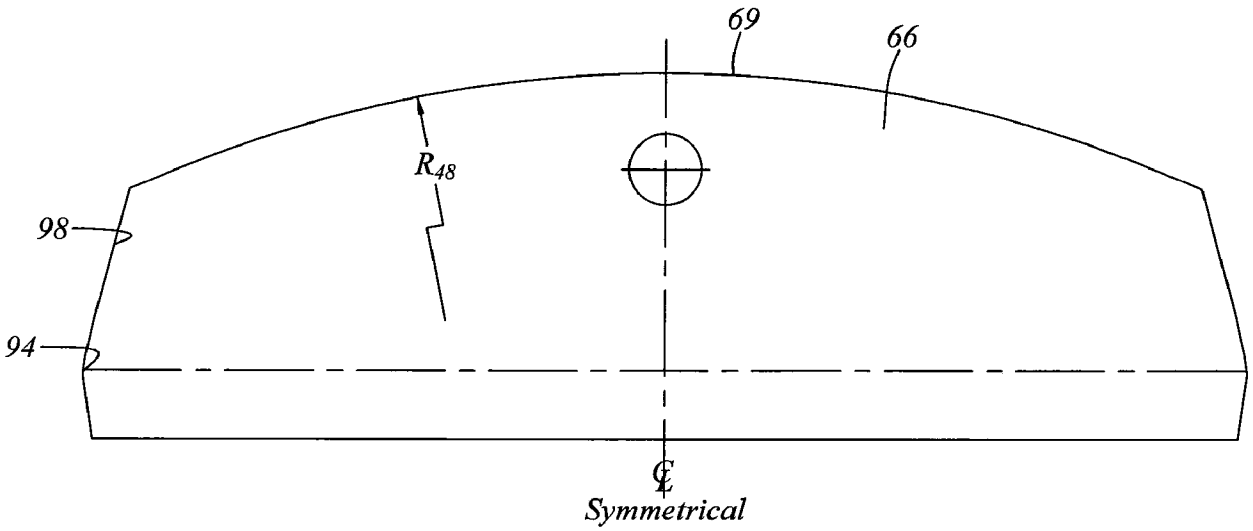
FIG. 2*a* is an enlarged view of an upper portion of an end sheet of the hopper of FIG. 1*a;*
Figure 2B:
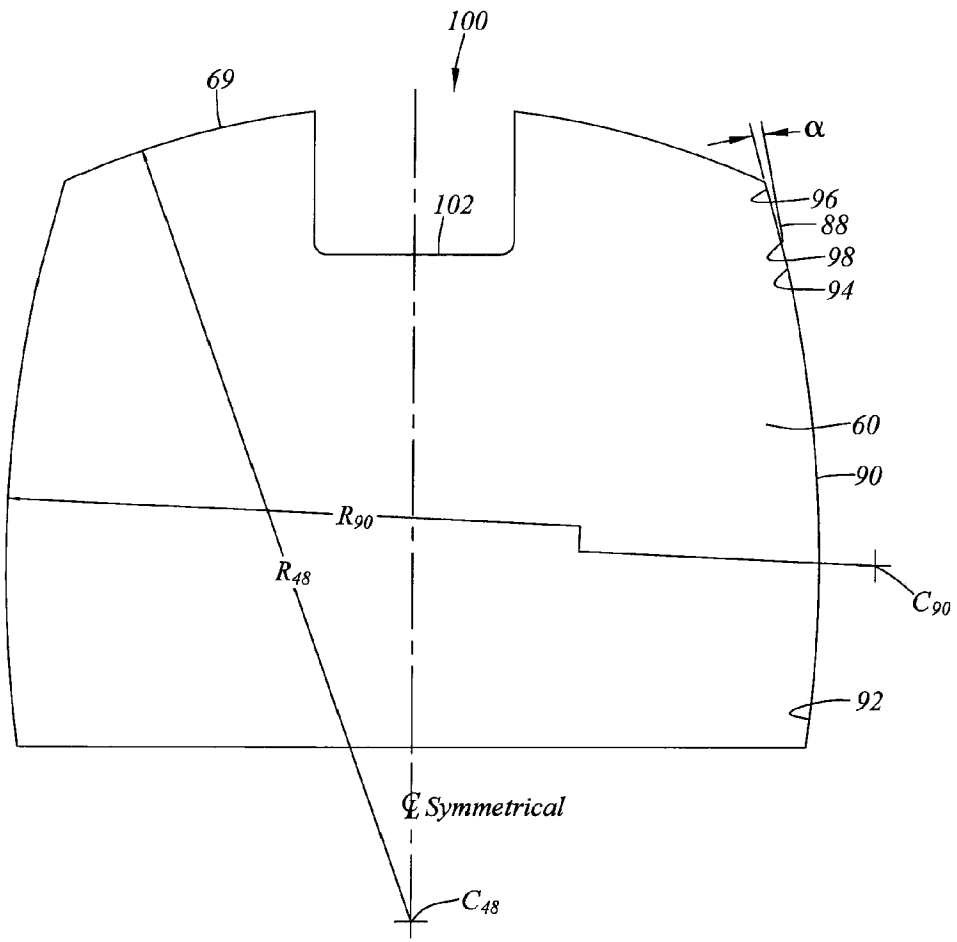
FIG. 2*b* is a plan view of an internal partition of the hopper car of FIG. 1*a;*

The description that follows, and the embodiments described therein, are provided by way of illustration of an example, or examples, of particular embodiments of the principles, aspects or features of the present invention. These examples are provided for the purposes of explanation, and not of limitation, of those principles and of the invention. In the description, like parts are marked throughout the specification and the drawings with the same respective reference numerals. The drawings are not necessarily to scale and in some instances proportions may have been exaggerated in order more clearly to depict certain features of the invention.

In terms of general orientation and directional nomenclature, for rail road cars described herein, the longitudinal direction is defined as being coincident with the rolling direction of the rail road car, or rail road car unit, when located on tangent (that is, straight) track. In the case of a rail road car having a center sill, the longitudinal direction is parallel to the center sill, and parallel to the top chords. Unless otherwise noted, vertical, or upward and downward, are terms that use top of rail, TOR, as a datum. In the context of the car as a whole, the terms lateral, or laterally outboard, or transverse, or transversely outboard refer to a distance or orientation relative to the longitudinal centerline of the railroad car, or car unit, or of the centerline of the centerplate. The term "longitudinally inboard", or "longitudinally outboard" is a distance taken relative to a mid-span lateral section of the car, or car unit. Pitching motion is angular motion of a railcar unit about a horizontal axis perpendicular to the longitudinal direction. Yawing is angular motion about a vertical axis. Roll is angular motion about the longitudinal axis. Given that the rail road car described herein may tend to have both longitudinal and transverse axes of symmetry, a description of one half of the car may generally also be intended to describe the other half as well, allowing for differences between right hand and left hand parts. Unless otherwise noted, it may be assumed that the structural components of railroad cars described herein are made of steel, most typically a mild steel having a yield strength of 50 kpsi, although other materials, such as aluminum or reinforced composite materials might be used in some instances.

In the context of the present disclosure, it may be helpful to define a cylindrical polar co-ordinate system. That is, in hopper cars having arcuate sides and arcuate roofs, the primary structural shell of the sides and roofs may have a generally cylindrical form. Some or all of the side sheet may be formed on a first radius of curvature about an axis that is parallel to the longitudinal centerline of the car, and part or all of the main roof sheet is formed on a second radius about a second axis parallel to the longitudinal centerline of the car.

The terminology employed in this specification is intended to be given its plain and ordinary meaning, as would be understood by persons of ordinary skill in the art of designing and fabricating rail road cars for North American service. The language used in this specification, and the appended claims, is to be interpreted in a manner consistent with the this disclosure and with any explicit meanings provided herein. To the extent that terminology used herein may have a specific meaning or usage in the North American rail road industry, it is to be given that meaning rather than any abstract dictionary meaning. To the extent that inventors are entitled to be their own lexicographers, the inventors explicitly exclude interpretations such as may be made by Examiners in the USPTO, or other patent offices, or that are based on abstract dictionary definitions, unless supported by rail road industry literature or by a dictionary specific to the rail road industry, as would be understood by persons skilled in the art in North America or in at least one country of the British Commonwealth.

FIG. 1*a* shows a side view of an example of a rail road freight car 20 that is intended to be representative of a wide range of rail road cars in which the present invention may be incorporated. While car 20 may be suitable for a variety of general purpose uses, it may be taken as being symbolic, and in some ways a generic example of, a flow through, or center flow car, in which lading is introduced by gravity flow from above, and removed by gravity discharge through gated or valved outlets below. Flow through, or center flow cars may include open topped hopper cars, grain cars, plastic pellet cars, potash cars, ore cars, and so on. In one embodiment car 20 may be a hopper car such as may be used for the carriage of bulk commodities in the form of a granular particulate, of which two examples might be grain or plastic resin feedstock pellets. With the exception of minor or ancillary fittings, the structure of car 20 may be symmetrical, or substantially symmetrical, about both its longitudinal and transverse, or lateral, centreline axes. Consequently, it will be understood that the car has first and second, left and right hand side beams, bolsters and so on.

By way of a general overview, car 20 may have a car body 22 that is carried on trucks 24 for rolling operation along railroad tracks. Car 20 may be a single unit car, or it may be a multi-unit car having two or more car body units, where the multiple car body units may be connected at an articulated connector, or by draw bars. Car body 22 may include a lading containment vessel or shell 26 such as may include an upstanding wall structure 28 which may include a pair of opposed first and second end walls 30, 32, that extend crosswise, and a pair of first and second side walls 34, 36 that extend lengthwise, the end walls 30, 32 and side walls 34, 36 co-operating to define a generally rectangular form of peripheral wall structure 28. Wall structure 28 may include top chords 38 running along or near the top or upper margin of the walls, and side sills 40 running fore-and-aft along lower portions of side sheets 42 of side walls 34, 36. In some instances car 20 may have stub center sills at either end, in which case side walls 34, 36 may act as deep beams, and may carry vertical loads to main bolsters that extend laterally from the centerplates. Alternatively, or in addition to deep side beams, car 20 may include a center sill 43, which may be a straight-through center sill, running from one end of the car body to the other, or a pair of stub sills mounted at either end of the car. In the case of a single, stand alone car unit, draft gear and releaseable couplers may be mounted at either end of the center sill. In a center flow, or flow-through car, the upper portion of the car may typically include means by which to admit lading under a gravity drop system. For example, there may be a roof, or roof assembly 44 such as may include one or more hatches 46 or troughs. The roof assembly may include a roof sheet 48 such as may be a monolith or an assembly of plates, or sheets, butt welded edge-to-edge. In the case of a hopper car, it is quite customary for the lower portion of the car to include a number of outlet hoppers 50, 52, for example, those hoppers having an inverted, generally pyramidal shape and having respective end slope sheets 54 and side slope sheets 56, as may be. Outflow may generally be governed by outflow gates or valves 58 mounted athwart the opening formed at the lower extremity of each hopper.

The interior of car body 22 may include lateral partitions 60 that may extend between the sidewalls of the car, in a manner such as may tend to divide the internal space of car body 22 into two or more sub-compartments, sub-volumes or sub-spaces, indicated generally as 62, and which may correspond to the catchments of hoppers 50 and 52 respectively. Clearly, in some embodiments there may be one single hopper, in others two hoppers and in others three, four, or more hoppers. As may be noted, end sheets 54 may be slope sheets, and internal partition sheets 60 may extend in a generally vertical plane upwardly of the junction of the internal end slope sheets 54 of a pair of adjacent hoppers, e.g., 50, 52. Not atypically, each pair of fore-and aft opposed slope sheets, be they end-of-car end sheets or internal end slope sheets, may be inclined at equal and opposite angles, and the angles of those sheets may be selected to be somewhat steeper than the free slope angle, or natural talus slope angle, of the lading for which the car is designed, such that, when the gates are opened, the lading may tend to flow out, rather than sit at rest. Internal partition sheets 60 may be stiffened by vertically extending reinforcements 64, such as may be channels spaced somewhat wider that the width of the coaming of the hatch. The end slope sheets at the ends of the car terminate at the car end walls, and meet an upper, or closing portion, or plate, identified as 66.

In the manufacture of these cars, the underfame is assembled, including the side sills, the slope sheets, and end wall plates, and partitions. At the same time the side sheets are butt welded together as a flat plate, and the top chord 38 is welded with its toes 70, 72 inward along the upper margin region 74 of the plate while it is flat, forming another sub-assembly. The welded top chord and plate margin form a hollow closed section beam that is relatively flexurally stiff as compared to the side sheet more generally. The two sub-assemblies are then married together by introducing the lower margin 76 of the main or lower portion 68 of the initially flat side sheet to seat inside the upper margin or flange 78 of the side sill. The side sheet is then bent or wrapped to conform to the underlying shape imposed on it by the partition sheets 60, slope sheets 54 and end plates 66 (which act as formers). Once formed to shape, the side sheet 42 is held in position while the roof sheet is positioned by forcing it to conform to the curvature of the upper edges 69 of partition 60 and plates 66, and then the upper margin of the side sheet assembly is secured to the roof sheet. The arcuate profiles to which the roof and side sheets may be formed may tend to have relatively large local radii of curvature. That is, the roof sheet 48 may be formed on a radius $R_{48}$ of curvature of the order of 100-160 inches, or perhaps more narrowly, about 112-144 inches. In one embodiment it may be about 130 inches. The side sheets 42 may be formed with still larger local radii of curvature, which may be in excess of 170 inches, and may be as much as perhaps 250 inches, or may lie in the narrower range of 192 to 240 inches. In one example, the greater portion of side sheet 42 may have a local radius of curvature of about 220 inches. The center of curvature of the side sheets 42 may lie rather above the side sill 40, perhaps in the range of ⅖ to ⅗ of the way up from side sill 40 toward top chord 38, or about half way or possibly slightly less. Although in the general case it may be that the local radius of curvature may be taken as a function of position on the curve, and the curve may be a polynomial, hyperbolic, assymptotic, or other curve, it may most typically be relatively easy to form a circular curve, or arc i.e., on a constant radius of curvature over a major portion, if not substantially all, of the arc.

In various embodiments, side sheet 42 may have a thickness in the range of about ⅛" to about ¼". More narrowly, it may be in the range of about 5/32" (or roughly 0.150") to about 13/64" (about 0.200"), or more narrowly still, in the range of about 0.170" to about 0.190". One particular embodiment may be 0.177", and another may be roughly 3/16". As may be appreciated, during the bending process, the sheets tend to be formed across relatively large unsupported spans between, e.g. partition sheet 60 and end plate 66.

It is often desirable that the thickness of the side sheets not be excessive, as this may tend to add unnecessary weight to the car. However, as the thickness is reduced, the aspect ratio of the thickness to the radius of curvature may become quite large, as may also the aspect ratio of the thickness of the material to the unsupported longitudinal spacing between the forming members e.g., the partitions and end wall forming plates. For example, an aspect ratio of 220" radius to ¼" thickness is 880:1. Where the aspect ratio is over about 750:1 or 800:1 or 900:1, either with respect to longitudinal spacing or with respect to the radius of curvature, the side sheet may have a tendency to sag or deflect between the frames away from the intended curvature. That is, it may tend to "oil can" or deflect in an unpredictable or indeterminate manner. Unintended inward deflection of a portion of the side sheet may also be termed a dent, or denting, and may be a form of buckling. When the aspect ratio exceeds 1000:1 the denting or oil canning problem may become quite common. In the inventors' observation, it tended to appear more commonly in the upper regions of the sides. It may be that the welding of the top chord to the upper margin of the side sheet, in its flat, pre-bending condition, tended to leave a non-uniform residual stress field in the material, and this may have tended to encourage the side sheet to pucker, or sag. This tendency may have been increased by the divergent spacing of the slope sheets.

Figure 3:
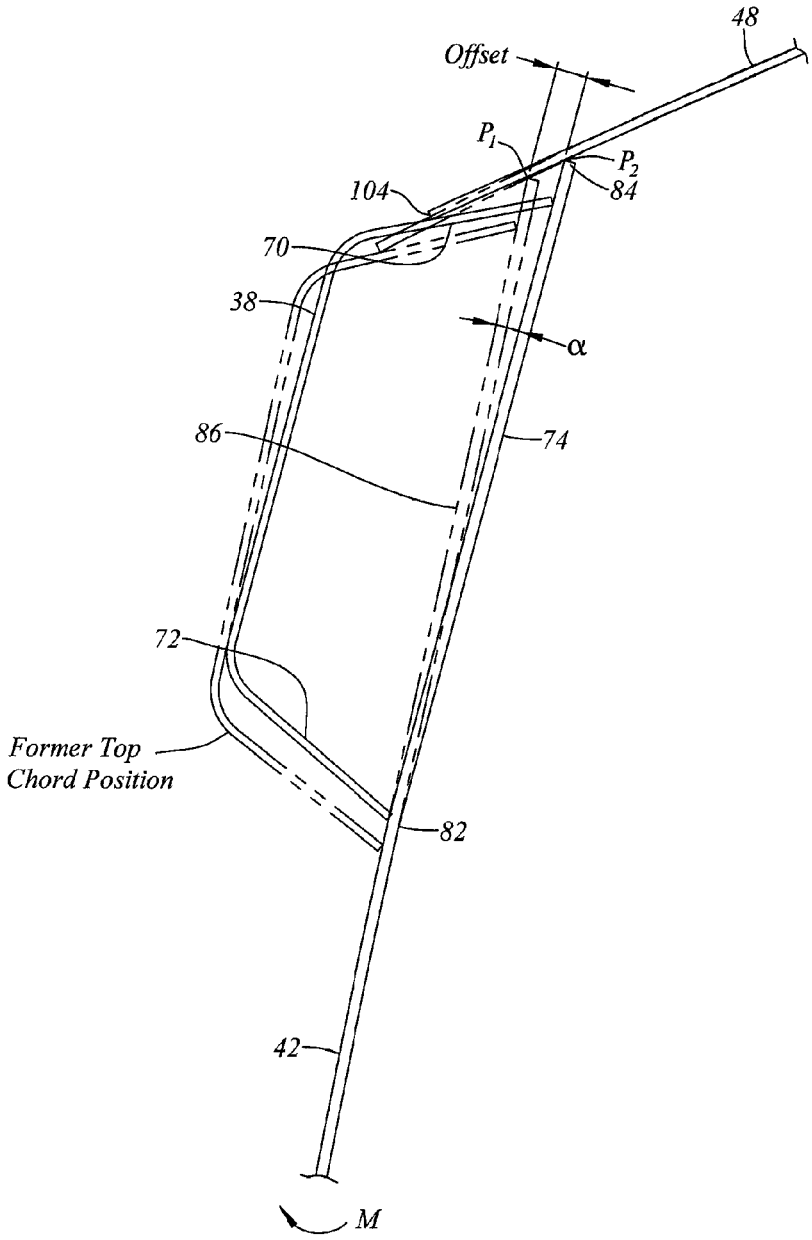
FIG. 3 is an enlarged construction detail of the hopper car of FIG. 1*a* taken on section '3-3' of FIG. 1*b.*

To discourage this from happening, rather than having the upper marginal portion 74 of the side sheet (the portion to which the top chord is welded) extend on a tangent of the (typically circular) arc of the side sheet generally, the upper margin may be kinked or bent on a sharper radius of curvature, as at a transition point 82 at which the profile of the sheet departs from the curve of the main or lower portion, prior to welding. That is, whereas the upper corner 84 of the upper margin region of the side sheet would otherwise lie in the neighbourhood of a point '$P_1$' if left as a tangential extension of the side sheet curve, (the constructed tangent being shown in phantom as 86), instead upper corner 84 is forced inward to lie at point '$P_2$', and a residual bending moment M is carried in the side sheet prior to welding the side sheet in place. This bending moment 'M' pre-loads the sheet, and tends to bias it to an outwardly bulging condition, rather than a sagging condition. The angular offset is indicated by angle alpha, and the lateral offset of the uppermost edge, or corner, 84 may be in the range of ⅜ to 1½ inches, or perhaps more, and in one embodiment is about ¾ inches, (+/−10%). Alpha may be in the range of 1 to 3°, or perhaps somewhat more, and in one embodiment may be about 2°. In effect, the kink at the upper edge turns the side sheet into a pre-loaded spring, and urges or biases it to maintain an outwardly bulging arcuate form rather than a form having an intermediate point of inflection of the second derivative of the slope. As viewed in FIG. 3, the bending moment has a clockwise sense relative to an axis parallel to the longitudinal axis of the car. Once the sheet is sprung it is welded in place with the spring loading retained in the sheet. Furthermore, the change in radius of curvature, even though seemingly small or subtle, in the region adjacent to, but below the juncture of the bottom leg of the top chord with the side sheet may tend to form a locus of interruption of the influence of the residual stress field that may remain when the fillet of the bottom leg to the side sheet cools. This locus of interruption, or change or tightening in curvature, or bend, or crease, lies between the bottom leg and the portion of the side sheet having the largest radius of curvature, and may tend to lie in what might be considered the region of flexural influence of the top chord. The extent of the region might be considered to extend a distance of up to about 25 to 40 times the thickness of the bottom leg, or 25 to 40 times the thickness of the side sheet away from the juncture of the top chord leg with the side sheet. In some embodiments that distance may be up to 10 times the thickness of the top chord leg or the side sheet thickness from the weld. In some embodiments, it may be less then 2 inches away.

The upper regions of the end plates and the partitions may be notched, or chamfered, or trimmed to the form or to accommodate the shape to be imposed on the upper region of the side sheet. For example, the partition may have a transversely outboard edge 90 having a lower region 92 having an arcuate profile, such as a circular profile of radius $R_{90}$ (e.g., of about 220 inches), a transition point 94, and an upper region 96 that may be chamfered or trimmed, as at 98, on an angle, alpha, inboard from the constructed extension of the curve of lower region 92, that construction being identified as 88. The off-set over the top portion from the tangent of the underlying curve may be of the order of ½ to 1½ inches, or perhaps somewhat more, and may, in one embodiment, be about ¾ inches (+/−10%).

The pulled-in portion need not be particularly large. That is, the overall side sheet arc length may be measured from the bottom edge or margin 76 seated at the side sill 40 to the top edge 84 mated to the roof sheet 48. This distance may be of the order of 110-120 inches in some car embodiments. The pulled-in portion may be of the order of 10-20 inches, so, taken as a percentage, the arc length of the pulled in portion may be roughly 5% or 10% to about 20% of the total arc length of the side.

This may be expressed differently. The central partition may have a central rebate, 100, which may have a threshold, or sill. This rebate is intended to allow clear passage of a delivery head such as may be used to fill the car. Most often, the lading will not submerge the end of the nozzle, or chute delivering the lading, so the portion of the car above the height of the sill 102 of rebate 100 may tend not to be filled with lading. Thus any minimal narrowing of the car above this level may be inconsequential in terms of altering the capacity of the car. Thus the upper, pulled in portion may be located at a height that is comparable to the height of sill 102 in partition 60, or predominantly (or completely) above that height.

This may be expressed differently. The side sheet has a first or main portion e.g., portion 68, and a second or upper, marginal portion 74. The main portion 68 is formed on a curve. There is a point (e.g. 82) at which the upper marginal portion 74 departs from the curvature of main portion 68 of the side sheet 42, that point 82 being a point (or a longitudinally extending line, really) of tangency from which a tangent line 86 may be constructed. The upper marginal portion 74 of the side sheet 42 assembly is deflected laterally inboard to a position shy of the tangent of the curve. Alternatively expressed, for a side sheet 42 formed on an arc, which may be a continuous arc, such as a circular arc, the upper marginal portion 74 departs from the circular arc, and at least part of that marginal end portion 74 lies closer to the center of curvature $C_{90}$ than does the main portion 68 of the side sheet formed on the constant radius of curvature of that circular arc.

Expressed differently yet again, a constructed continuation 86 of the curve of the main portion 68 of the side sheet 42 may be extended upward, to meet the arcuate form of the roof sheet 48 to define an enclosure zone. In car 20, the upper marginal portion 74 of the side sheet, including the upper extremity 84 thereof, lies inside this zone. The upper marginal portion 74 lies laterally or transversely inboard of the constructed extension 86 of the side wall curve.

As pre-loaded in this way, the upper margin of the side sheet is held in place, and the roof sheet 48 is placed in position. The outboard edge 104 of the roof sheet is first tack welded to upper leg 70 of top chord 38, then fillet welds are made where the upper edge 84 of the side sheet 42 meets the underside of the roof sheet 48, along the mating edge 104 of the roof sheet 48 with the top chord leg 70, and along the edges of the partitions 60, end plates 66, and slope sheets 54.

Although the foregoing description has been made in the context of an example of a covered hopper car, such as a grain or plastic pellet car, open topped hopper cars, such as coal and aggregate cars, may also employ a top chord and side sheet arrangement that has been twisted or deflected laterally inward in a corresponding manner.

Various embodiments have been described in detail. Since changes in and or additions to the above-described examples may be made without departing from the nature, spirit or scope of the invention, the invention is not to be limited to those details.

We claim:

1. A railroad hopper car, said hopper car having a body for carrying lading, said body including side sheets, one of said side sheets having a first portion and a second portion, said first portion being a lower portion and said second portion being an upper portion extending therefrom, at least part of the lower portion being formed on an arc, said lower portion of said side sheet having an inboard side and an outboard side, said arc being concave to the inboard side of said lower portion of said side sheet, said upper portion of said side sheet from said arc deviating from said arc to the concave side, said side sheet having a spring pre-load tending to urge said side sheet to an outwardly bulging condition.

2. The railroad hopper car of claim 1 wherein said lower portion is a main portion of said side sheet, and said upper portion is a marginal portion of said side sheet.

3. The railroad hopper car of claim 2 wherein:

said arc is a circular arc having a center of curvature;

at least a portion of said upper, marginal portion of said side sheet is located closer to said center of curvature than said lower portion of said side sheet.

4. The railroad hopper car of claim 1 wherein said first portion has a first length, said second portion has a second length, and said second length is in the range of 5% to 15% of said first length.

5. The railroad hopper car of claim 1 wherein said side sheet is installed in a spring loaded condition tending to urge said first portion to said outwardly bulging condition.

6. The railroad hopper car of claim 1 wherein a top chord member is mounted to said second portion.

7. The railroad hopper car of claim 6 wherein said hopper car comprises a roof sheet, and at least one of (a) said top chord member; and (b) said second portion is rigidly connected to said roof sheet.

8. The railroad hopper car of claim 7 wherein said connection to said roof sheet maintains said side sheet in a spring loaded condition.

9. The railroad hopper car of claim 1 wherein said side sheet meets at least one of the following conditions:

(a) said arc has a radius of curvature of at least 170 inches;

(b) said side sheet has a thickness and said arc is formed on a circular arc having a radius of curvature, there being an aspect ratio of said radius of curvature to said thickness that is at least as great as 900.

10. An internal forming member for a railroad hopper car, said forming member having a first profile portion to which a side sheet of the hopper car is to conform; said first profile portion including a lower portion and an upper portion; at least part of said lower portion being formed on an arc, said arc bulging laterally outboard and being concave laterally inboard, and having a radius of curvature of magnitude R about a center of curvature, C, that radius of curvature being larger than 170 inches, said upper portion deviating from said arc to the concave side, and at least part of said upper portion lying closer than R to said center of curvature C.

11. A railroad hopper car, said hopper car having a body for carrying lading, said body including a longitudinally extending, predominantly upwardly standing side sheet formed on an arcuate profile, said side sheet having a first portion and a second portion adjoining the first portion, the second portion and the first portion meeting at a transition, said first portion being formed on a curve, said second portion deviating from said curve at said transition; and, at least a portion of said second portion lying transversely inboard of an extension of said curve.

12. The railroad hopper car of claim 11 wherein said first portion is a main portion of said side sheet, and said second portion is a marginal portion of said side sheet.

13. The railroad hopper car of claim 11 wherein said first portion is a lower portion of said side sheet, and said second portion is an upper portion of said side sheet.

14. The railroad hopper car of claim 13 wherein:

said curve is a circular arc having a center of curvature;

at least a portion of said upper portion of said side sheet being located closer to said center of curvature than said lower portion of said side sheet.

15. The railroad hopper car of claim 13 wherein:

said hopper car includes an arcuate roof sheet;

said first portion of said side sheet is a main portion;

said second portion of said side sheet is an upper, marginal portion;

said main portion is formed on a substantially circular arc;

a top chord member is mounted to said upper marginal portion;

said roof sheet has a laterally outboard margin connected to said top chord member;

said upper, marginal portion of said side sheet terminates at, and is connected to, said roof sheet;

said curve is a circular arc having a center of curvature;

said curve has a radius of curvature of greater than 170 inches;

said side sheet has a thickness;

said side sheet has an aspect ratio of said radius of curvature to said thickness that is greater than 900; and at least a portion of said upper, marginal portion of said side sheet being located closer to said center of curvature than said lower portion of said side sheet.

16. The railroad hopper car of claim 11 wherein said side sheet is installed in a spring loaded condition tending to urge said first portion to an outwardly bulging condition.

17. The railroad hopper car of claim 11 wherein a top chord member is mounted to said second portion.

18. The railroad hopper car of claim 17 wherein said hopper car comprises a roof sheet, and at least one of (a) said top chord member; and (b) said second portion is rigidly connected to said roof sheet.

19. The railroad hopper car of claim 18 wherein said connection to said roof sheet maintains said side sheet in a spring loaded condition.

20. The railroad hopper car of claim 11 wherein said side sheet meets at least one of the following conditions:

(a) said curve has a radius of curvature of at least 170 inches;

(b) said side sheet has a thickness and said curve is formed on a circular arc having a radius of curvature, there being an aspect ratio of said radius of curvature to said thickness that is at least as great as 900.

21. The railroad hopper car of claim 11 wherein:

said hopper car body has a side sill extending therealong and a top chord extending therealong, said top chord being spaced upwardly from said side sill;

said predominantly upwardly standing side sheet extending between said side sill and said top chord;

said first portion is a lower portion of said side sheet, said second portion is an upper portion of said side sheet;

said first portion extends upwardly of said side sill; and said second portion is closer to said top chord than is said first portion.

22. The railroad hopper car of claim 21 wherein said upper portion and said lower portion meet at a transition, said upper portion being kinked at said transition relative to said lower portion.

* * * * *